United States Patent [19]

Achard et al.

[11] Patent Number: 4,780,368

[45] Date of Patent: Oct. 25, 1988

[54] YARNS AND FIBERS WITH GOOD PROPERTIES, BASED ON A MIXTURE OF POLYVINYL CHLORIDE AND POSTCHLORINATED POLYVINYL CHLORIDE

[75] Inventors: Georges Achard, Dé cines; Pierre Chion, Bron; Jacques Menault, Charbonnieres-Les-Bains, all of France

[73] Assignee: Rhovyl, Neuilly-Sur-Seine, France

[21] Appl. No.: 825,946

[22] Filed: Feb. 3, 1986

Related U.S. Application Data

[63] Continuation of Ser. No. 328,523, Dec. 8, 1981, abandoned.

[30] Foreign Application Priority Data

Dec. 8, 1980 [FR] France ..... 80 26047

[51] Int. Cl.[4] ..... D01F 6/10

[52] U.S. Cl. ..... 428/364; 264/168; 264/205; 264/210.2; 264/210.7; 264/210.8; 264/211.15; 264/289.6; 428/373

[58] Field of Search ..... 428/364, 394, 373; 526/334.3, 334.2; 264/210.8, 205, 184, 289.6, 235.6, 168, 210.2, 210.7, 211.15

[56] References Cited

U.S. PATENT DOCUMENTS 3,372,219 3/1968 Gord ..... 264/210
3,424,833 1/1969 Mazzolini et al. ..... 264/168

FOREIGN PATENT DOCUMENTS 643658 11/1964 Belgium ..... 264/184
1359178 7/1964 France .
1381340 1/1975 United Kingdom .

*Primary Examiner*—Jan H. Silbaugh
*Assistant Examiner*—Hubert C. Lorin
*Attorney, Agent, or Firm*—Stevens, Davis, Miller & Mosher

[57] ABSTRACT

The present invention relates to filaments based on a mixture of atactic polyvinyl chloride and post-chlorinated polyvinyl chloride, and also to the process for their production.

The filaments according to the present invention possess a residual shrinkage in boiling water of less than 2%, a modulus of elasticity of more than 3 $kN/mm^2$ and a shrinkage stress, after shrinkage in an aqueous fluid medium at a temperature between 98° and 130° C., which is greater than or equal to $1.6 \cdot 10^{-2}$ g/dtex.

The filaments are obtained by spinning and stretching in a manner which is in itself known, then continuous stabilization under tension, at a temperature between 105° and 125° C., in the presence of steam under pressure, for 1 to 3 seconds, and then shrinkage in an aqueous fluid medium at a temperature between 98° and 130° C.

The filaments according to the invention can be used, by themselves or blended with other filaments, for the production of woven fabrics, knitted fabrics and non-woven articles.

7 Claims, No Drawings

YARNS AND FIBERS WITH GOOD PROPERTIES, BASED ON A MIXTURE OF POLYVINYL CHLORIDE AND POSTCHLORINATED POLYVINYL CHLORIDE

This application is a continuation of application Ser. No. 328,523, filed 12/8/81, now abandoned.

The present invention relates to filaments, yarns, fibers, monofilaments and other similar articles made of synthetic material, which consist of polyvinyl chloride and postchlorinated polyvinyl chloride. It relates more particularly to yarns and fibers with better mechanical properties.

It is already known from French Pat. No. 1,359,178 to prepare yarns and fibers consisting of mixtures of ordinary polyvinyl chloride and postchlorinated polyvinyl chloride, the latter being present in a proportion of between 5% and 80% and preferably of at least 10%.

The fibers thus obtained have the ability to withstand heat treatment temperatures which is enhanced as the percentage of postchlorinated vinyl chloride in the mixture increases, and this has the consequence of reducing the residual heat shrinkage. On the other hand, high percentages of postchlorinated polyvinyl chloride substantially increase the cost of the yarns and fibers obtained, all the more so because the process for their production is a batch process, in particular in fixing heat treatment.

French Pat. No. 85,126/1,359,178 also recommends the use of mixtures of atactic polyvinyl chloride and postchlorinated polyvinyl chloride in a proportion of 5 to 50% of the mixture, and specifies that, after spinning and stretching, the fibers obtained can be directly shrunk by heating in a suitable medium, for example boiling water, instead of being stabilised under tension under the conditions indicated in the main patent. However, in practice, the abovementioned treatment conditions only make it possible to obtain fibers with good properties if the proportion of postchlorinated polyvinyl chloride is relatively large. In the single example in this patent, the tensile strength and elongation of the yarns obtained are good by virtue of the relatively large proportion of postchlorinated polyvinyl chloride, namely 20% by weight. On the other hand, for lower contents postchlorinated polyvinyl chloride and lower stretching ratios, such properties are impossible to obtain by direct shrinkage in boiling water. At and above 20% by weight of postchlorinated polyvinyl chloride, although the mechanical properties of the fibers are much better, their cost also increases as a consequence.

The difficulty with this type of mixture of atactic polyvinyl chloride and postchlorinated polyvinyl chloride thus consists, in fact, in finding a compromise which makes it possible to obtain fibers possessing the best possible mechanical properties for the lowest possible cost.

The present invention relates to yarns and fibers based on a mixture of atactic polyvinyl chloride and postchlorinated polyvinyl chloride, with good mechanical characteristics, even for mixtures containing a lower proportion of postchlorinated polyvinyl chloride, and which are obtained by means of a continuous industrial process, that is to say under the best possible economic conditions.

More precisely, it relates to filaments, fibers and yarns based on a mixture of atactic polyvinyl chloride and postchlorinated polyvinyl chloride, which possess a residual shrinkage in boiling water of less than 2%, a modulus of elasticity of more than 3 kN/mm$^2$ and a shrinkage stress, after shrinkage in an aqueous fluid medium at a temperature between 98° and 130° C., which is greater than or equal to $1.6 \cdot 10^{-2}$ g/dtex.

Preferably, the modulus of elasticity is between 3 and 5 kN/mm$^2$, the shrinkage stress, after shrinkage at a temperature between 98° and 130° C. in an aqueous fluid medium, is between 2 and $3.5 \cdot 10^{-2}$ g/dtex and the residual shrinkage in boiling water is less than or equal to 1%.

The present invention also relates to a process for the production of these yarns and fibers based on a mixture of atactic polyvinyl chloride and postchlorinated polyvinyl chloride, by spinning of the mixture of polymers from a solution in a manner which is in itself known, stretching of the filaments in boiling water in a ratio of between 3 and 6 X, continuous stabilisation under tension at a temperature between 105° and 125° C., in the presence of steam under pressure, for 1 to 3 seconds, and then shrinkage at a temperature between 98° and 130° C. in an aqueous fluid medium.

The term "atactic polyvinyl chloride" is understood as meaning essentially vinyl chloride homopolymer having a glass transition temperature which is generally between 65° and 85° C. Polyvinyl chloride consists predominantly of the atactic isomeric form, that is to say that it is a polymer in which the majority of the chlorine atoms and hydrogen atoms are located randomly on both sides of the chain constituting the backbone of the molecule. Thus, a polymer of this type is normally of a non-crystallisable nature. A polymer of this type is most commonly obtained in the least expensive way by the known techniques of bulk polymerisation, suspension polymerisation or emulsion polymerisation at temperatures which are generally above 0° C. and more generally between 20' and 60° C. or even higher.

The postchlorinated polyvinyl chloride which can be used according to the pesent invention can be obtained, for example, by the chlorination of a suspension of polyvinyl chloride in the presence of actinic light, or by chlorination at high temperature, or in the presence of active chemical radiation; it generally has a glass transition temperature of at least 100° C.

According to the present invention, it is preferred to use a proportion of 16 to 20% by weight of postchlorinated polyvinyl chloride, relative to the mixture of the two polymers. The process of the invention can also be applied to mixtures containing more than 20% of chlorinated polyvinyl chloride, and in this case also leads to better mechanical properties of the yarns, but the articles thus produced have a higher cost.

It is possible to drop below a proportion of 16% of postchlorinated polyvinyl chloride (for example down to 12% or even 10%), but the conditions of the process must then be optimum in order for the yarns obtained to possess acceptable mechanical properties. For example, it is then necessary for the yarns to be stretched very close to their maximum stretchability, and for the stabilisation temperature also to be raised to its maximum, while avoiding the risks of breakage or sticking, which would reduce the flexibility of the process according to the invention.

The yarns and fibers according to the present invention possess a high modulus of elasticity of at least 3 kN/mm$^2$ and generally of between 3 and 5 kN/mm$^2$. This modulus of elasticity is high for fibers based on a polyvinyl chloride/postchlorinated polyvinyl chloride mixture, the modulus of which is generally of the order of 2 to 2.5 kN/mm$^2$ for the same proportion of postchlorinated polyvinyl chloride. This is an important fact because the modulus is representative of the mechanical characteristics of the fibers obtained (strength and elongation) and permits a good workability of the yarns and fibers without the latter shrinking during the subsequent textile work. This high value of the modulus of elasticity of the yarns and fibers according to the invention is all the more advantageous because it is accompanied by a very low residual shrinkage in boiling water, namely a residual shrinkage of less than 2% and more generally of less than 1% or even less than 0.5%.

In fact, it is usually easier to obtain a good modulus of elasticity with yarns based on polyvinyl chloride if a higher residual shrinkage, for example of the order of 5% or more, is acceptable. However, such characteristics lead to difficulties which are not easily overcome at the stage of the subsequent textile work.

Furthermore, with the yarns and fibers according to the present invention, a better control of their degree of orientation is achieved at the final stage, that is to say after shrinkage in the aqueous fluid. In the present application, the degree of orientation is expressed by the shrinkage stress of the yarns and fibres obtained.

The shrinkage stress of the filaments is measured by means of a shrinking tester the samples of 4 cm long filaments, grouped together in the form of test-pieces having an average gauge of 400 dtex (each experiment being carried out on two test-pieces), are subjected, after each of the various steps of stretching, stabilisation and finally shrinkage, to a temperature increase of 1° C. per minute from 30° C. to 170° C. The shrinkage force, expressed in $10^{-2}$ g/dtex, is measured on each test-piece as a function of the temperature. In each case, this shrinkage stress of shrinkage force passes through a maximum at a certain temperature. It is this maximum shrinkage force which represents the molecular orientation characteristics of the products, which is designated by shrinkage stress.

After the last stage of the process, that is to say the shrinkage in the aqueous fluid, the yarns and fibres obtained according to the present application retain a shrinkage stress of at least $1.6 \cdot 10^{-2}$ g/dtex, whereas the yarns, based on polyvinyl chloride/postchlorinated polyvinyl chloride mixtures, such as obtained in accordance with the example in French Pat. No. 85,126/1,359,178, possess, after shrinkage in boiling water, a shrinkage stress of $1 \cdot 10^{-2}$ g/dtex for an identical proportion of postchlorinated polyvinyl chloride, relative to the mixture (compare the comparison example below).

The yarns and fibers according to the present invention can be obtained in accordance with any known process such as, for example, spinning from solution by a dry or wet process, preferably a dry process.

It is possible to use solution of known solvents or solvent mixtures, such as perchloroethylene/acetone mixtures, tetrahydrofuran, cyclohexanone, and mixtures of benzene or acetone or of carbon disulphide and acetone in appropriate proportions. This list not implying a limitation.

In the wet spinning process, the filaments are coagulated in a bath which is a non-solvent for the polymer mixture but is miscible with the solvent, whereas in the dry spinning process, the solvent is evaporated off by means of hot air and generally recovered. The concentration of polymer in the solutions is generally of the order of 20–30% by weight in the dry spinning process and only of the order of 10–20% by weight in the wet spinning process, the solutions preferably being filtered before spinning, in each case, in order to remove the particles of gel or dirt which are capable of obstructing the spinneret orifices.

After spinning, which is preferably carried out by a dry process, the filaments are stretched, in order to give them a molecular orientation and to improve their mechanical characteristics, in a ratio of between 3 and 6 X. Preferably, the stretching of the filaments according to the present invention comprises pre-heating, for example in water, at temperatures between 60° and 100° C. and more generally between 75° and 85° C. A practical method consists in using a heated water-bath. The actual stretching can be carried out in 1 or 2 stages, but it is preferred to raise the temperature of the filaments progressively by pre-heating, pre-stretching, for example in a bath in which the water can be kept at between 70° and 95° C. and then continuous stretching at a temperature slightly above that of the pre-stretching, preferably at between 85° and 100° C. the overall stretching ratio being of the order of 3 to 6 X and preferably of 3.5 to 5. In order to be able to obtain an overall stretching ratio of 6, it is easier to limit the stretching of the filaments just downstream of the spinneret, by adjusting the speed of the take-up rollers.

The filaments stretched in this way then undergo stabilisation under tension, in order to prevent any shrinkage, in the presence of steam under pressure, at a temperature between 105° and 130° C. and preferably between 110° and 120° C., for 1 to 3 seconds.

After stabilisation, they are subjected, preferably continuously, to free shrinkage, which can be carried out in boiling water for a variable period of time, for example of at least 10 minutes and generally of 10 to 20 minutes or even longer, or in saturated steam, for example by passage through a nozzle such as that described in French Pat. No. 83,329/1,289,491. In a nozzle of this type, the filaments are treated with saturated steam at a temperature between 110° and 130° and are simultaneously shrunk and crimped, which permits a better subsequent textile workability.

In the case where the shrinkage is carried out in boiling water, this is preferably preceded by mechanical crimping in accordance with any known process, also for the purpose of improving the subsequent workability.

The process according to the present invention can be carried out totally continuously from the stretching, or even from the dissolving of the polymers, up to the production of the definite yarns or fibers. Thus, it is easy to carry out economically on an industrial scale.

The polymers in solution, spun according to the present application, may contain usual additives such as light stabilisers, heat stabilisers, fluorescent brighteners, pigments, and dyestuffs capable of improving some of their properties, such as their color, the dyeing affinity, the heat and light stability, the electrical resistivity and the like.

A process of this type leads to filaments with better mechanical characteristics than those of yarns, based on polyvinyl chloride/postchlorinated polyvinyl chloride mixtures, obtained according to French Pat. Nos. 1,359,178 and 85,126/1,359,178, for an equal content of postchlorinated polyvinyl chloride. The mechanical characteristics are also better than those of filaments based on atactic polyvinyl chloride alone, treated in accordance with the process of the present invention, which forms the subject of a patent application filed on the same day.

The filaments and fibers according to the present invention can undergo all the appropriate textile conversions and can be used, by themselves or blended with other fibers, for the production of woven fabrics, knitted fabrics and non-woven articles, and, in particular, can undergo all the usual washing and dry-cleaning treatments under appropriate conditions.

The yarns and fibers according to the invention are also of particular value in the textile field because of certain properties inherent in the composition of the mixtures, namely non-flammability, light resistance, chemical inertness and thermal, electrical and acoustic insulating power.

The examples which follow, in which the parts are by weight, are given by way of indication but without implying a limitation.

EXAMPLE 1

A polymer solution with a concentration of 28% by weight, in a 50/50 by volume solvent mixture of carbon disulphide and acetone, is prepared.

The polymer consists of a mixture of 82.5% by weight of predominantly atactic polyvinyl chloride (AFNOR index: 120 according to AFNOR Standard Specification T 51-013; chlorine content: 56.5%) and 17.5% of postchlorinated polyvinyl chloride having a chlorine content of 69% and an AFNOR index of 110.

The solution thus obtained is filtered and, whilst being kept at about 70° C., is spun through a spinneret possessing 908 orifices of diameter 0.06 mm, into a dry-spinning cell permitting the continuous recovery of the solvent mixture, such as described in French Pat. No. 913,927. The filaments are subsequently pre-heated in a water-bath kept at 80° C., then stretched a first time in a water-bath kept at 85° C., in a ratio of 2.9 X, and then stretched a second time in a second water-bath kept at 95° C. in a ratio of 1.2 X (total ratio: 3.5 X). The filaments are then stabilised continuously under tension in a tube containing saturated steam at 105° C., the input and output speeds of the filaments being strictly identical and their residence time in the tube being 2 seconds.

The filaments then undergo mechanical crimping and free shrinkage in boiling water for 20 minutes.

The filaments thus obtained possess the characteristics given in the table below.

EXAMPLE 2

Example 1 is repeated, modifying only the stabilisation temperature in the tube, in the presence of saturated stem, which is 110° C. The filaments obtained possess the characteristics given in the table below.

EXAMPLE 3

Example 1 is repeated exactly, except that the filaments are stabilised, in the presence of steam, at a temperature of 120° C.

The characteristics of the filaments are grouped together in the table below:

| | Example 1 | Example 2 | Example 3 |
|---|---|---|---|
| Gauge per strand, dtex | 2.57 | 2.47 | 2.31 |
| Residual shrinkage (in boiling water), % | 0.9 | 0.9 | 0.9 |
| Tensile strength, cN/tex | 16.7 | 17.7 | 21.2 |
| Elongation, % | 46.8 | 40.3 | 36.8 |
| Modulus of elasticity, kN/mm$^2$ | 3.31 | 4.13 | 5.06 |
| Shrinkage stress, $10^{-2}$ g/dtex — after stretching | 11.7 | 11.7 | 11.7 |
| Shrinkage stress, $10^{-2}$ g/dtex — after fixing | 7.7 | 7.3 | 7.75 |
| Shrinkage stress, $10^{-2}$ g/dtex — after shrinkage | 1.8 | 1.9 | 2.35 |

By way of comparison, a solution of a mixture of polymers identical to that described in Example 1 is spun under the conditions indicated above. The filaments are stretched under the same conditions and in the same ratio; they possess the following characteristics before and after direct shrinkage in boiling water for 20 minutes;

| | |
|---|---|
| shrinkage stress after stretching | $11.7 \cdot 10^{-2}$ g/dtex |
| shrinkage stress after direct shrinkage in boiling water | $1 \cdot 10^{-2}$ g/dtex |

other characteristics after shrinkage in boiling water:

| | |
|---|---|
| tensile strength | 13.45 cN/tex |
| elongation | 69.6% |
| modulus of elasticity | 2.8 kN/mm$^2$ |

EXAMPLE

A solution identical to that described in Example 1 is prepared and spun in the same manner through an identical spinneret.

The filaments are subsequently pre-heated in a water-bath kept at 80° C., then stretched a first time in a water-bath at 85° C., in a ratio of 2.5 X, and then stretched again, in a ratio of 1.46 X, in a bath at 95° C., so as to obtain a total stretching of 3.65 X.

The filaments then undergo a continuous stabilisation treatment in the presence of steam under pressure, at 105° C., for two seconds, under tension, the input and output speeds of the filaments being identical.

The filaments then pass continuously through a nozzle such as described in French Pat. No. 83,329/1,289,491, where they are subjected continuously to a shrinkage treatment in steam, at an average temperature of 120° C., and crimped.

The characteristics of the filaments obtained are as follows:

| | |
|---|---|
| Gauge per strand, dtex | 2.41 |
| Residual shrinkage in boiling water, % | 0.35 |
| Tensile strength, cN/tex | 18.4 |
| Elongation, % | 47.4 |
| Modulus of elasticity, kN/mm$^2$ | 3.27 |
| Shrinkage stress, $10^{-2}$ g/dtex — after stretching | 12.7 |
| Shrinkage stress, $10^{-2}$ g/dtex — after fixing | 8.7 |
| Shrinkage stress, $10^{-2}$ g/dtex — after shrinkage | 2 |

In the above examples, the measures of the tensile strength are carried out with a known apparatus trade named "Instron": the maximum force supported by a sample is measured and the ratio force/gauge is calculated, the force being measured with a constant elongation gradient.

What is claimed is:

1. Filaments based on mixtures of atactic polyvinyl chloride and postchlorinated polyvinyl chloride, wherein the proportion of postchlorinated polyvinyl chloride in said mixture is less than 20% by weight relative to the mixture, and said filaments possess the following properties:

a residual shrinkage in boiling water of less than 2%, a modulus of elasticity which is greater than or equal to 3 $kN/mm^2$, and a shrinkage stress, after shrinkage in an aqueous fluid medium at a temperature between 98° and 130° C., which is greater than or equal to $1.6 \cdot 10^{-2}$ g/dtex, said filaments having been made by dry spinning from solution, in a stretching stage the filaments having been stretched in boiling water at a draw ratio of between 3 and 6 X, in a stabilisation stage stabilised continuously under tension at a temperature between 105° and 130° C. in the presence of steam under pressure, for 1 to 3 seconds, and then shrunk in an aqueous fluid medium at a temperature between 98° and 130° C.

2. Filaments according to claim 1 wherein the stretching stage comprises:

pre-heating of the filaments, pre-stretching of the filaments at a temperature between 70° and 95° C., and subsequently stretching at a temperature between 85° and 100° C.

3. Filaments according to claim 1, wherein the stabilisation stage is carried out at a temperature between 110° and 120° C.

4. Filaments according to claim 1, wherein the shrinkage is carried out in boiling water for at least 10 minutes.

5. Filaments according to claim 1, wherein the shrinkage is carried out in the presence of saturated steam, at a temperature between 110° and 130° C.

6. Filaments according to claim 1, wherein the yarns undergo mechanical crimping after the stabilisation stage.

7. Filaments according to claim 1, wherein the residual shrinkage in boiling water is less than or equal to 1%, the modulus of elasticity is between 3 and 5 $kN/mm^2$ and the shrinkage stress, after shrinkage at a temperature between 98° and 130° C. in an aqueous fluid medium, is between 2 and $3.5 \cdot 10^{-2}$ g/dtex.

* * * * *